United States Patent [19]

Stewart

[11] 4,086,037

[45] Apr. 25, 1978

[54] DIAPHRAGM PUMP

[75] Inventor: John M. Stewart, Thornhill, Canada

[73] Assignee: Sanitation Equipment Limited, Downsview, Canada

[21] Appl. No.: 729,061

[22] Filed: Oct. 4, 1976

[30] Foreign Application Priority Data

Dec. 23, 1975 Canada ..... 242435

[51] Int. Cl.[2] ..... F04B 43/04; F04B 39/10

[52] U.S. Cl. ..... 417/571

[58] Field of Search ..... 417/413, 564, 571

[56] References Cited

U.S. PATENT DOCUMENTS

| | | | |
|---|---|---|---|
| 2,253,206 | 8/1941 | Farrow, Jr. et al. | 417/413 |
| 2,285,215 | 6/1942 | Lotz | 417/413 |
| 2,935,248 | 5/1960 | Gerters | 417/564 |
| 3,049,284 | 8/1962 | Alamprese | 417/480 |
| 3,539,276 | 11/1970 | Matsura | 417/413 |
| 3,671,151 | 6/1972 | Duke et al. | 417/413 |
| 3,776,666 | 12/1973 | Ludwig | 417/413 |
| 3,825,374 | 7/1974 | Konda | 417/413 |

FOREIGN PATENT DOCUMENTS

| | | | |
|---|---|---|---|
| 1,236,367 | 7/1960 | France | 417/413 |
| 1,298,728 | 6/1962 | France | 417/413 |
| 444,460 | 1/1949 | Italy | 417/413 |

*Primary Examiner*—William L. Freeh

*Attorney, Agent, or Firm*—Rogers, Bereskin & Parr

[57] ABSTRACT

A diaphragm pump is described having a pump chamber fitted with an insert. The insert defines a concave end face positioned closely adjacent the diaphragm of the pump. The concave face of the insert and the diaphragm together define an effective portion of the pump chamber which is swept by the diaphragm when the pump is in use. The insert is formed with inlet and outlet passageways through which fluid flows to and from said effective portion of the pump chamber.

3 Claims, 2 Drawing Figures

DIAPHRAGM PUMP

Figure 1:
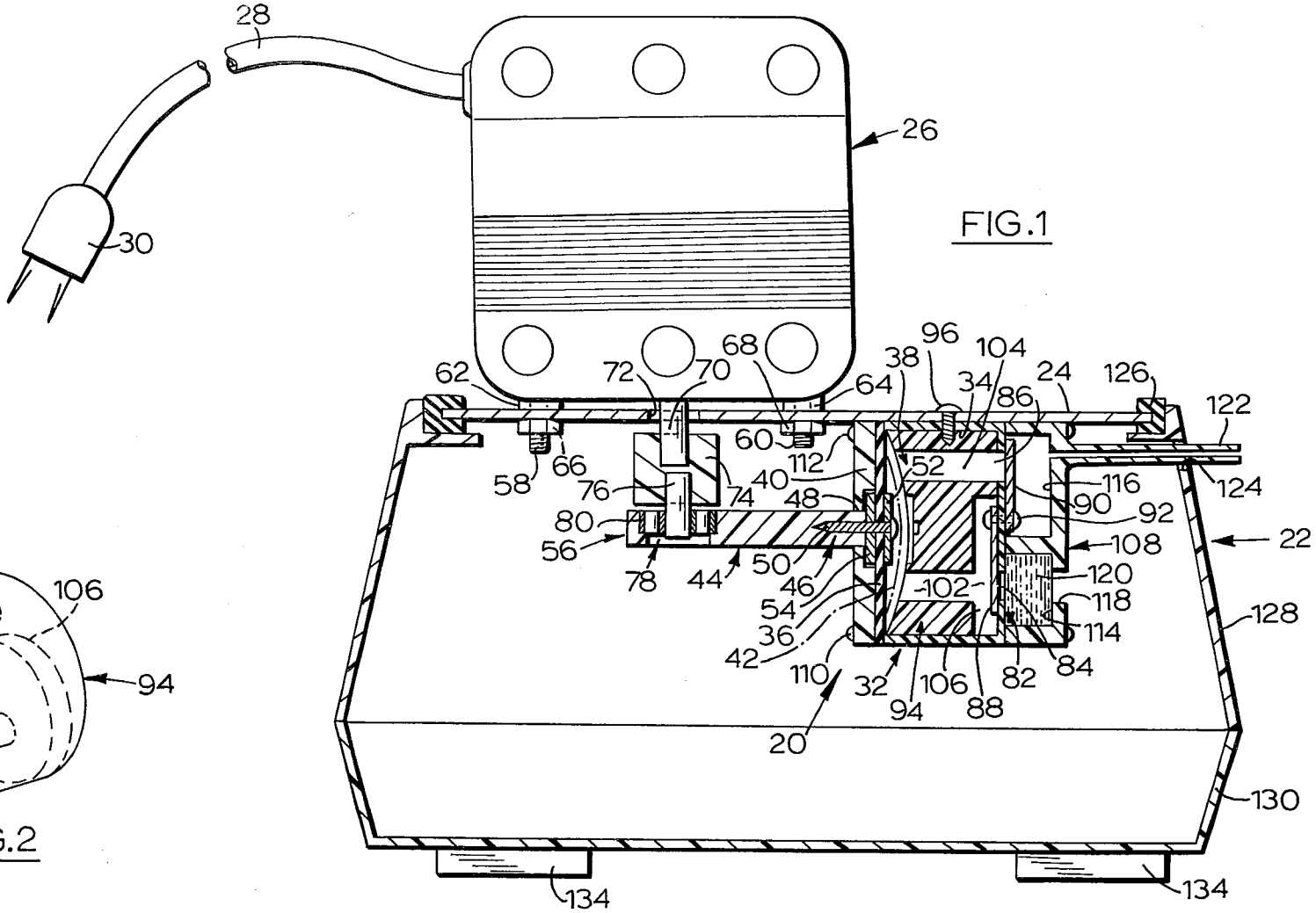

This invention relates generally to diaphragm pumps. In particular, the invention has been devised in connection with small capacity diaphragm pumps for use in aquarium aeration systems. It is however to be understood that the invention is not limited to this application and may be employed in diaphragm pumps for other purposes.

An object of the present invention is to provide a diaphragm pump which is of improved efficiency compared with comparable pumps of conventional design.

According to the invention, the pump includes a housing defining a cavity and a flexible diaphragm extending across the cavity and defining therein a pump chamber at one side of the diaphragm. The diaphragm has a peripheral portion which is arranged in fluid-tight relationship with respect to the housing. The remainder of the diaphragm is deflectable between a position in which the diaphragm is generally flat and a position in which the diaphragm is of outwardly bowed convex configuration. Drive means are provided for repeatedly moving the diaphragm between its generally flat and outwardly bowed positions. The pump also includes inlet means and outlet means communicating with the pump chamber for conducting a fluid to be pumped respectively to and from the chamber. First valve means is associated with the inlet means for controlling entry of fluid to the chamber and second valve means is associated with the outlet means for controlling delivery of fluid from the chamber. An insert is disposed in the pump chamber and defines a concave end face of a shape which is generally complimentary to the shape of the diaphragm in said outwardly bowed configuration. The insert is located at a position such that its end face is disposed closely adjacent to the diaphragm when the latter is in said outwardly bowed configuration. The end face defines with the diaphragm an effective portion of the pump chamber which closely corresponds in volume to the volume swept by the diaphragm in moving between its said positions. Two passageways are formed in the insert. The passageways communicate respectively with the inlet means and the outlet means and both open into the end face of the insert, so that a fluid to be pumped is conducted to and from said effective portion of the pump chamber along said passageways in use.

The invention also provides an insert for use in a diaphragm pump as described above.

Figure 2:
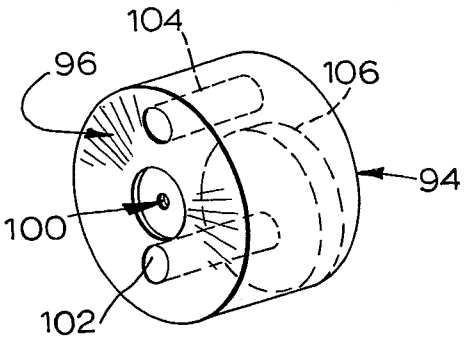

The invention will be better understood by reference to the accompanying drawings which illustrate a preferred embodiment of the invention by way of example. In the drawings:

FIG. 1 is a vertical cross-sectional view of a diaphragm pump according to the invention intended primarily for use as an aquarium air pump; and, FIG. 2 is a perspective view of part of the pump of FIG. 1.

Reference will first be made to FIG. 1 in describing the main components of the pump. The pump includes a pumping assembly generally indicated at 20, which will be described in more detail later. Assembly 20 is mounted in a casing 22 having a flat top 24 which supports a motor 26. Motor 26 is a conventional single speed, non-reversible electric motor which operates on a 110-volt supply. The motor is designed to provide a constant rotational output speed of 1550 r.p.m. An electrical supply cord for motor 26 is indicated at 28 and is fitted at its outer end with a plug 30.

The pumping assembly 20 includes a housing 32 which defines an internal cavity 34. Housing 32 and cavity 34 are both of cylindrical shape. A resiliently flexible diaphragm 36 extends across one end of cavity 34 and defines inside housing 32 a pump chamber generally denoted 38. The diaphragm is held in place by an end plate 40 which is secured to the housing 32 and by which the peripheral margin of the diaphragm is trapped against the housing. Diaphragm 36 is made of polyurethane and is deflectable between the generally flat position in which it is shown and a position in which the diaphragm is of outwardly bowed convex configuration as indicated in chain line at 42.

When the pump is in use, the diaphragm is repeatedly moved to and fro between its said positions by a connecting rod 44 which is continuously reciprocated by motor 26. One end 46 of rod 44 passes through an opening 48 in plate 40. Diaphragm 36 is attached to end 46 of rod 44 by a screw 50. Reinforcing washers 52 and 54 are provided on respectively opposite sides of the diaphragm at the position of the screw. The opposite end 56 of rod 44 is coupled to the electric motor 26 as described below.

Motor 26 is supported on the top plate 24 of the pump casing 22 by four screw threaded legs, two of which are indicated at 58 and 60. Each leg is fitted with a rubber bush 62, 64 respectively positioned below the motor. The lower end portions of the leg receive nuts 66, 68 respectively which are tightened against the underside of plate 24 so that the motor is resiliently supported.

The motor 26 has a vertical output shaft 70 which projects downwardly through an opening 72 in plate 24. The lower end portion of shaft 70 is fitted with an eccentric which includes a plastic bush 74 secured to shaft 70 by a grub screw (not shown). A circular section pin 76 projects downwardly from bush 78 at a position offset from the axis of the motor drive shaft 70. Pin 76 is received in the inner race of a roller bearing 78 fitted in a recess 80 in the outer end 56 of the connecting rod 44 referred to above. Accordingly, when the motor 26 is in operation, the rotary motion of output shaft 70 is converted into a reciprocatory motion of the connecting rod 44, causing diaphragm 46 to move back and forth as described above.

Referring back to the pumping assembly 20, housing 32 includes an outer end wall 82 formed with two circular openings 84 and 86 disposed on a common diameter of the wall. These openings form respectively an air inlet and an air outlet for the pump chamber 38. Inlet 84 is provided with a flap valve 88 on the inside of wall 82 and outlet 86 is provided with a flap valve 90 on the outside of wall 82. The two flap valves 88 and 90 are held in contact with the wall by a rivet 92 which extends through the inner ends of both valves and through wall 82. As will be appreciated, valve 88 will be opened by air drawn into housing 32 through inlet 84, whereas valve 90 will be opened by air leaving the housing through outlet 86.

An insert 94 of generally cylindrical shape (see also FIG. 2) is received in the pump chamber 38 between diaphragm 36 and the end wall 82 of housing 32. Insert 94 is of a length to fit substantially exactly between the diaphragm and the end wall so that virtually no axial movement of the insert is possible. In addition, the insert is retained by a screw 96 which extends downwardly through the top plate 24 of the pump casing, through housing 32 and into the insert 94. Screw 96 prevents any axial movement of insert 94. The screw also serves to hold the entire assembly 20 against the underside of plate 24. Insert 94 is dimensioned to fit snugly inside cavity 34 in substantially airtight fashion.

Insert 94 has a concave end face 98 which is of a shape generally complimentary to the shape of the diaphragm 36 in said outwardly bowed configuration. As a result of the position of the insert, the diaphragm overlies said concave face 98 of the insert when the diaphragm is in said outwardly bowed position indicated at 42. It will be noted that the central portion of face 98 is formed with a recess 100 of a shape complimentary to the shape of the head of screw 50 and washer 52 so that the diaphragm can move into close contact with face 98. It will also be noted that the end face 98 has a peripheral margin which is in contact with and airtightly sealed against diaphragm 36. Accordingly, face 98 and diaphragm 36 define the portion of the pump chmaber 38 which is effective when the pump is in use. The volume of this effective portion of chamber 38 closely corresponds to the volume swept by the diaphragm in moving between its generally flat position and its outwardly bowed position.

Two passageways 102, 104 are formed in the insert 94 and communicate respectively with the air inlet 84 and the air outlet 86 of housing end wall 82. Both passageways open at their opposite ends into the concave end face 98 of insert 94. The positions of the passageways can clearly be seen in FIG. 2. It will be noted that both passageways extend axially of the insert on a common diametral plane. Passageway 102 communicates with a recess 106 in the outer end wall of insert 94, which recess accommodates the flap valve 88 associated with air inlet 84.

The end wall 82 of housing 32 is provided with a moulded plastic fitment 108. Fitment 108 is secured to housing 32 by a series of rivets which are spaced around the housing 32 and the heads of two of which are visible at 110 and 112. These rivets also hold the end plate 40 in position. Fitment 108 defines two cylindrical chambers 114 and 116 which communicates respectively with air inlet 84 and air outlet 86. Chamber 114 also has an opening 118 which communicates with the interior of the pump casing 22. A filter 120 of conventional material is received in chamber 114. Chamber 116 communicates with an integral outlet tube 122 which projects through an opening 124 in the pump casing. The internal diameter of tube 122 is relatively small compared with the diameter of chamber 116 and accordingly has the effect of throttling the output from chamber 116.

As can be seen from the drawings, the majority of the components of the pumping mechanism are made of a synthetic plastic material. The top plate 24 of the casing is metal and is fitted with a peripheral rubber strip 126 secured by adhesive to the remainder of casing. The casing includes an upper casing part 128 and a lower casing part 130 both made of a plastic material and secured together at a joint 132. The casing is supported on rubber feet 134. The casing is filled with foam insulation (not shown) to minimize noise.

It will be appreciated that connection of motor 26 to a suitable electrical supply will cause the connecting rod 44 to continously reciprocate generally in the axial direction of the housing 32 of the pumping assembly. This in turn will cause the diaphragm to repeatedly move between the generally flat position in which it is shown and the outwardly bowed positon indicated in chain dotted line at 42.

Each time the diaphragm moves from the straight line position to the bowed position, air in front of the diaphragm will be displaced along passageway 104 and will cause flap valve 90 to open, allowing the air to enter chamber 116. Return movement of the diaphragm from the bowed position to the flat position will cause a reduction in pressure in both passageway 104 and in passageway 102. Reduced pressure in passageway 104 will cause the flap valve 90 to be drawn into tight engagement with the end wall 82. The reduced pressure in passageway 102 on the other hand will cause valve 84 to open, drawing air into the passageway through the opening 118 in fitment 108 and through the filter 120. At the next stroke of the diaphragm, the sequence will be repeated, and valve 84 will of course close and valve 90 will open as described above. It will be noted that the opening 124 in the casing at the position of the tube 122 is of significantly larger diameter than the tube itself so that air can be drawn into the casing through the opening and from there into the pump assembly as described above.

The pump illustrated in the drawings provides a number of significant advantages compared with conventional pumps of comparable size. Firstly, the provision of insert 94 in the pump chamber 38 makes for a higher pressure output than that which is normally available from a pump of the type in question. This is because the maximum volume of the effective portion of the pump chamber, defined between the curved end face 94 of insert 94 and the diaphragm, closely corresponds to the volume swept by the diaphragm at each stroke. In other words, the diaphragm sweeps substantially the whole of the effective volume of the pump chamber. As a result, the pressure output of the pump is at a maximum. By way of illustration, a typical conventional aquarium pump of comparable size may have a pressure output of the order of 5 p.s.i. whereas the pump of the present invention may produce an output of the order of 11 p.s.i.

Also, the output of the pump of the invention is substantially constant, compared with the pulsating output normally produced by a pump of this type. This substantially contant output occurs due to the presence of chamber 116 and due to the throttling effect of tube 122 in the output of the pump. Chamber 116 acts as a reservoir having a restricted outlet (tube 122). When the pump is in operation, the air in chamber 116 is partly pressurized by the incoming air driven by the diaphragm. The pressurized air progressively escapes from chamber 116 through tube 122, producing a substantially constant output.

It should be noted that the drawings illustrate a preferred embodiment of the invention only and that many modifications are possible within the broad scope of the invention. For example, any suitable drive means may be employed to reciprocate the diaphragm. If a substantially constant pump output is required, constant stroke drive means should be employed in order that the diaphragm shall reciprocate a constant amount at each stroke. The diaphragm and housing need not be of similar shape in cross-section. Also, different valve arrangements could be used for the air inlet and outlet of the pump chamber. In another alternative construction, the diaphragm of the pump could be double acting and the housing could be arranged to define two pump chambers, one on each side of the diaphragm, each chamber receiving an insert. Also it is to be noted that a suitably dimensioned insert may be provided for fitment in the pump chamber of a conventional pump to improve its output. Finally, as indicated above, the invention may be applied to diaphragm pumps other than aquarium air pumps whether for pumping liquids or gases.

What I claim as my invention is:

1. A diaphragm pump comprising:

a housing of hollow cylindrical shape which defines a cylindrical cavity having first and second ends, and which includes an end wall at said first end of said cavity, said second end being open, and said end wall of the housing being formed with an inlet opening and an outlet opening, both communicating with said cavity;

a flexible diaphragm extending across said second end of the cavity and defining a pump chamber at one side of the diaphragm, the diaphragm having a peripheral portion which is arranged in fluid-tight relationship with respect to the housing, the remainder of the diaphragm being deflectable between a position in which the diaphragm is generally flat and a position in which the diaphragm is of outwardly bowed convex configuration;

drive means for repeatedly moving the diaphragm between said generally flat position and said outwardly bowed position;

first valve means associated with said inlet opening in the end wall of the housing for controlling entry of fluid to said pump chamber;

second valve means associated with said outlet opening in the end wall of the housing for controlling delivery of fluid from said chamber; and, a generally cylindrical insert disposed in said pump chamber and dimensioned to fit closely in the said chamber between said end wall and said diaphragm, said insert defining, adjacent said diaphragm, a concave end face of a shape which is generally complementary to the shape of the diaphragm in said outwardly bowed configuration, and which defines with the diaphragm an effective portion of the pump chamber which closely corresponds in volume to the volume swept by the diaphragm in moving between its said positions, the insert being formed with two passageways which communicate respectively with said inlet and outlet openings in the end wall of the pump housing, and both of which open into said end face of the insert, so that a fluid to be pumped is conducted to and from said effective portion of the pump chamber along said passageways in use.

2. A pump as claimed in claim 1, wherein said first and second valve means comprise flap valves secured to respectively opposite sides of said end wall for closing said inlet and outlet openings.

3. A pump as claimed in claim 1, further comprising means coupled to said housing and defining a reservoir communicating with said outlet means and an outlet from said chamber, said outlet having a relatively small diameter serving to restrict the flow of fluid from the chamber whereby fluid delivered to said reservoir by the action of the diaphragm when the pump is in use issues from said outlet at a relatively constant rate.

* * * * *